US007204137B1

(12) United States Patent
Skalchunes

(10) Patent No.: US 7,204,137 B1
(45) Date of Patent: Apr. 17, 2007

(54) THREAD BREAKAGE DETECTION SYSTEMS AND METHODS

(75) Inventor: Peter J. Skalchunes, Clemmons, NC (US)

(73) Assignee: Essex, Inc., Winston-Salem, NC (US)

( * ) Notice: Subject to any disclaimer, the term of this patent is extended or adjusted under 35 U.S.C. 154(b) by 0 days.

(21) Appl. No.: 10/644,485

(22) Filed: Aug. 20, 2003

(51) Int. Cl.
*G01L 5/04* (2006.01)

(52) U.S. Cl. ..... 73/159

(58) Field of Classification Search ..... 112/470.01, 112/278, 273, 475.02, 447, 470.31, 470.05, 112/80.18; 242/475.7; 250/205, 227.11; 340/517, 347 P; 73/862.474, 159; 428/375; 128/303.1; 606/11
See application file for complete search history.

(56) References Cited

U.S. PATENT DOCUMENTS 3,587,497 A * 6/1971 Beaxley ..... 112/278
3,818,236 A * 6/1974 Lind et al. ..... 250/559.43
4,186,995 A 2/1980 Schumacher
4,300,599 A * 11/1981 Wueger ..... 139/352
4,388,613 A * 6/1983 Rush et al. ..... 341/14
4,501,114 A * 2/1985 von Ronai-Horvath et al. 57/81
4,519,332 A 5/1985 Fukuda
4,538,536 A * 9/1985 Sick ..... 112/273
4,602,582 A * 7/1986 Rawson ..... 112/278
4,622,910 A * 11/1986 Hangarter et al. ..... 112/447
4,625,666 A * 12/1986 Sick ..... 112/273
4,691,647 A * 9/1987 von Stein ..... 112/80.18
4,742,789 A * 5/1988 Pestel et al. ..... 112/475.05
4,754,722 A * 7/1988 Rohr et al. ..... 112/278
4,841,890 A * 6/1989 Tancs ..... 112/273
4,844,580 A 7/1989 Lynch et al.
4,856,441 A 8/1989 Kurata
4,867,080 A 9/1989 Taylor et al.
4,883,054 A * 11/1989 Fuller et al. ..... 606/12
4,976,018 A * 12/1990 Bollen ..... 28/187
4,981,091 A 1/1991 Taylor et al.
5,006,701 A * 4/1991 Kothe et al. ..... 250/205
5,104,391 A * 4/1992 Ingle et al. ..... 606/11

(Continued)

FOREIGN PATENT DOCUMENTS

GB 2136564 * 9/1984

OTHER PUBLICATIONS

Essex, Inc. Magna-Beam Brochure © 1998 Essex Incorporated.

*Primary Examiner*—Michael Cygan
*Assistant Examiner*—Octavia Davis
(74) *Attorney, Agent, or Firm*—Kilpatrick Stockton LLP

(57) ABSTRACT

A thread breakage detection apparatus comprises a light source operable to generate a light beam, an emitter in communication with the light source, the emitter operable to emit the light beam, and a receiver in communication with and disposed in facing opposition to the emitter, the receiver operable to receive the light beam emitted from the emitter and to communicate the light beam to a sensor. The emitter comprises an emitter lens and a first fiber optic cable comprising proximate and distal ends. The proximate end of the first cable in communication with the light source and the distal end of the first cable in communication with the emitter lens. The receiver comprises a receiving lens and a second fiber optic cable comprising proximate and distal ends, the proximate end of the second cable in communication with the receiving lens and the distal end of the second cable in communication with the sensor.

35 Claims, 4 Drawing Sheets

U.S. PATENT DOCUMENTS 5,199,365 A * 4/1993 Arnold ..... 112/273
5,383,417 A 1/1995 Norrid
5,832,851 A * 11/1998 Kato ..... 112/470.01
6,080,982 A * 6/2000 Cohen ..... 250/227.11
6,163,733 A * 12/2000 Rubel ..... 700/130
6,259,517 B1 * 7/2001 Tedesco et al. ..... 356/73.1
6,360,615 B1 * 3/2002 Smela ..... 73/862.474
6,392,214 B1 5/2002 Okamoto
6,455,829 B1 9/2002 Fukumura
6,512,868 B1 1/2003 Foster et al.
6,555,806 B2 4/2003 Okamoto
6,578,989 B2 6/2003 Osumi et al.
6,742,916 B1 * 6/2004 Dunn ..... 362/477
2003/0215172 A1 * 11/2003 Koenig ..... 385/15

* cited by examiner

THREAD BREAKAGE DETECTION SYSTEMS AND METHODS

FIELD OF INVENTION

This invention relates to products and processes for detecting thread breakage in a sewing apparatus.

BACKGROUND

A sewing apparatus operates by piercing fibers or threads into a base fabric with needles. A sewing apparatus typically includes a needle which receives thread through its eye from a source of thread which may be mounted on the body of the sewing machine or remotely therefrom. The thread generally follows a path through various thread guides or guide plates on the machine, through a thread tensioning device, a thread take-up device, and then through other guide means mounted above the needle. The thread is then directed through the eye of the needle. The take-up device pulls the thread tight between the needle and the thread tensioning device. While the sewing apparatus is in operation, a threaded needle moves in a reciprocal fashion and continually inserts thread into a passing base fabric.

An example of a sewing apparatus includes a carpet tufting apparatus having a needle bar carrying a plurality of needles for inserting yarns carried by said needles into a base fabric for producing loops of yarns. The loops of yarns can be formed into loops of different heights or cut to form cut loop carpet.

A common problem associated with any sewing apparatus is the detection of thread breakage during operation before the broken thread is sewn or inserted into the base fabric. For example, during the carpet tufting process, when one of the multitude of yarns breaks while the carpet tufting apparatus is in operation, the eventual absence of thread in the corresponding needle creates a gap defect, or "mend," in the carpet. A relatively short mend, such as less than 0.5 meters, in a carpet sample can be corrected using a hand-held device, but longer mends are much more difficult—or even impracticable—to fix. Thus, yarn breakage often results in carpet waste, which increases the ultimate cost of production.

To reduce the length of a mend, reduce the number of mends, or prevent mends in a sewing article, the sewing apparatus must stop operating as soon as possible after a thread breaks. Various types of thread breakage monitoring devices have been developed for stopping a sewing apparatus—or at least providing a warning signal—after thread breakage has been detected.

A variety of optical devices have been used in an attempt to effectively detect thread breakage. Two examples of such devices can be found in U.S. Pat. No. 4,625,666 to Sick and U.S. Pat. No. 4,691,647 to von Stein. Generally, such devices attempt to detect thread breakage by projecting a light beam near or onto the threads of a sewing apparatus. These devices are typically grouped into two categories: light-on and dark-on. When a thread breaks and either falls into (dark-on) or out of the light beam (light-on), a photo-sensor detects a change in the light beam and sends a signal to a controller or alarm indicating thread breakage.

In typical dark-on optical sensing systems, a light beam is positioned near a thread or a bank of threads such that a photo-sensor receives a generally continuous beam of light while the threads are intact. When a thread breaks and passes or falls through the path of the light, the thread temporarily interrupts the light beam. The photo-sensor detects this interruption in the light beam—i.e., a quantity of light lower than a predetermined threshold quantity of light—and sends a signal indicating that the light beam has been interrupted or broken.

The closer the light beam is positioned to a thread, the greater the likelihood a broken thread will interrupt or fall through the light beam. To position the light beam closely to the thread normally requires that the optical device be attached or mounted directly to the sewing apparatus. The size of known thread breakage detection devices—in particular the photo-sensor emitters and receivers of these devices—prevents placement of the light beam in positions near the threads, which would help ensure or increase the consistency of thread breakage detection.

Further reducing the accuracy and consistency of thread breakage detection is the vibration typical of sewing apparatuses. Vibration of sewing apparatuses—especially those used on an industrial scale—is common. Such vibration often jars the light emitter and/or receiver of the optical thread breakage detection device out of alignment. Not only does such misalignment interrupt the production process, but misalignment can often be difficult to detect, resulting in mend defects.

Known optical thread breakage detection systems also require precise alignment to consistently and accurately detect thread breakage. Machine vibration further reduces the accuracy and consistency of such systems. Thus, there is a need for an optical thread breakage detection apparatus that can be positioned near the thread of a sewing apparatus and that also is generally less susceptible to misalignment caused by machine vibration.

SUMMARY OF INVENTION

The present invention provides products and processes for detecting thread breakage in a textile sewing apparatus. In one exemplary embodiment, a thread breakage detecting apparatus adapted to be coupled to a textile sewing apparatus comprises a light source, an emitter, and a receiver. The light source is operable to generate a light beam. The emitter is disposed in communication with the light source. The emitter is operable to emit the light beam. The emitter comprises an emitter lens and a first fiber optic cable. The fiber optic cable comprises proximate and distal ends. The proximate end of the first fiber optic cable is disposed in communication with the light source and the distal end of the fiber optic cable disposed in communication with the emitter lens. The receiver is disposed in communication with the emitter. The receiver is operable to receive the light beam and to communicate the light beam to a sensor. The receiver comprises a receiving lens and a second fiber optic cable. The second fiber optic cable comprises proximate and distal ends. The proximate end of the second fiber optic cable is disposed in communication with the receiving lens and the distal end of the second fiber optic cable is disposed in communication with the sensor. The receiving lens is disposed in facing opposition to the emitter lens.

In another exemplary embodiment, a system comprises a textile sewing apparatus and a thread breakage detection apparatus coupled to the textile sewing apparatus. The thread breakage detection apparatus comprises a light source, an emitter, and a receiver. The light source is operable to generate a light beam. The emitter is disposed in communication with the light source. The emitter is operable to emit the light beam. The emitter comprises an emitter lens and a first fiber optic cable. The fiber optic cable comprises proximate and distal ends. The proximate end of the first fiber optic cable is disposed in communication with the light source and the distal end of the fiber optic cable disposed in communication with the emitter lens. The receiver is disposed in communication with the emitter. The receiver is operable to receive the light beam and to communicate the light beam to a sensor. The receiver comprises a receiving lens and a second fiber optic cable. The second fiber optic cable comprises proximate and distal ends. The proximate end of the second fiber optic cable is disposed in communication with the receiving lens and the distal end of the second fiber optic cable is disposed in communication with the sensor. The receiving lens is disposed in facing opposition to the emitter lens.

In a further exemplary embodiment, a method of detecting thread breakage in a textile sewing apparatus comprises providing a light source operable to generate a light beam, providing an emitter operable to emit the light beam, and providing a receiver operable to receive the light beam and to communicate the light beam to a sensor. The emitter comprises an emitter lens and a first fiber optic cable. The first fiber optic cable comprises proximate and distal ends. The proximate end of the first fiber optic cable is disposed in communication with the light source and the distal end of the fiber optic cable is disposed in communication with the emitter lens. The receiver comprises a receiving lens and a second fiber optic cable. The second fiber optic cable comprises proximate and distal ends. The proximate end of the second fiber optic cable is disposed in communication with the receiving lens and the distal end of the fiber optic cable is disposed in communication with the sensor. The receiving lens is disposed in facing opposition to the emitter lens.

An advantage of the present invention can be to provide a thread breakage detection apparatus that is adapted to be disposed proximate, i.e., within several millimeters, to a thread disposed in a textile sewing apparatus.

Another advantage of the present invention can be to provide a thread breakage detection apparatus that is adapted to be less susceptible to misalignment resulting from machine vibration.

Yet another advantage of the present invention can be to provide a thread breakage detection apparatus that is adapted to operate without precise alignment between a light emitter and a light receiver.

Still another advantage of the present invention can be to provide a thread breakage detection apparatus that is adapted to detect thread breakage spanning a distance in a range between approximately 1 meter to approximately 4 meters.

These exemplary embodiments are mentioned not to summarize the invention, but to provide an example of an embodiment of the invention to aid understanding. Exemplary embodiments are discussed in the Detailed Description, and further description of the invention is provided there. Advantages offered by the various embodiments of the present invention may be understood by examining this specification.

BRIEF DESCRIPTION OF DRAWINGS

The accompanying drawings, which constitute part of this specification, help to illustrate the embodiments of the invention. In the drawings, like numerals are used to indicate like elements throughout.

DETAILED DESCRIPTION

Embodiments of the present invention comprise products and processes for detecting thread breakage in a textile sewing apparatus, such as for example, in a carpet tufting machine. While the present invention is described herein as a dark-on through-beam detector, the principles of the invention are applicable to light-on detectors. Furthermore, the principles of the invention are not limited to through-beam detectors.

Figure 1:
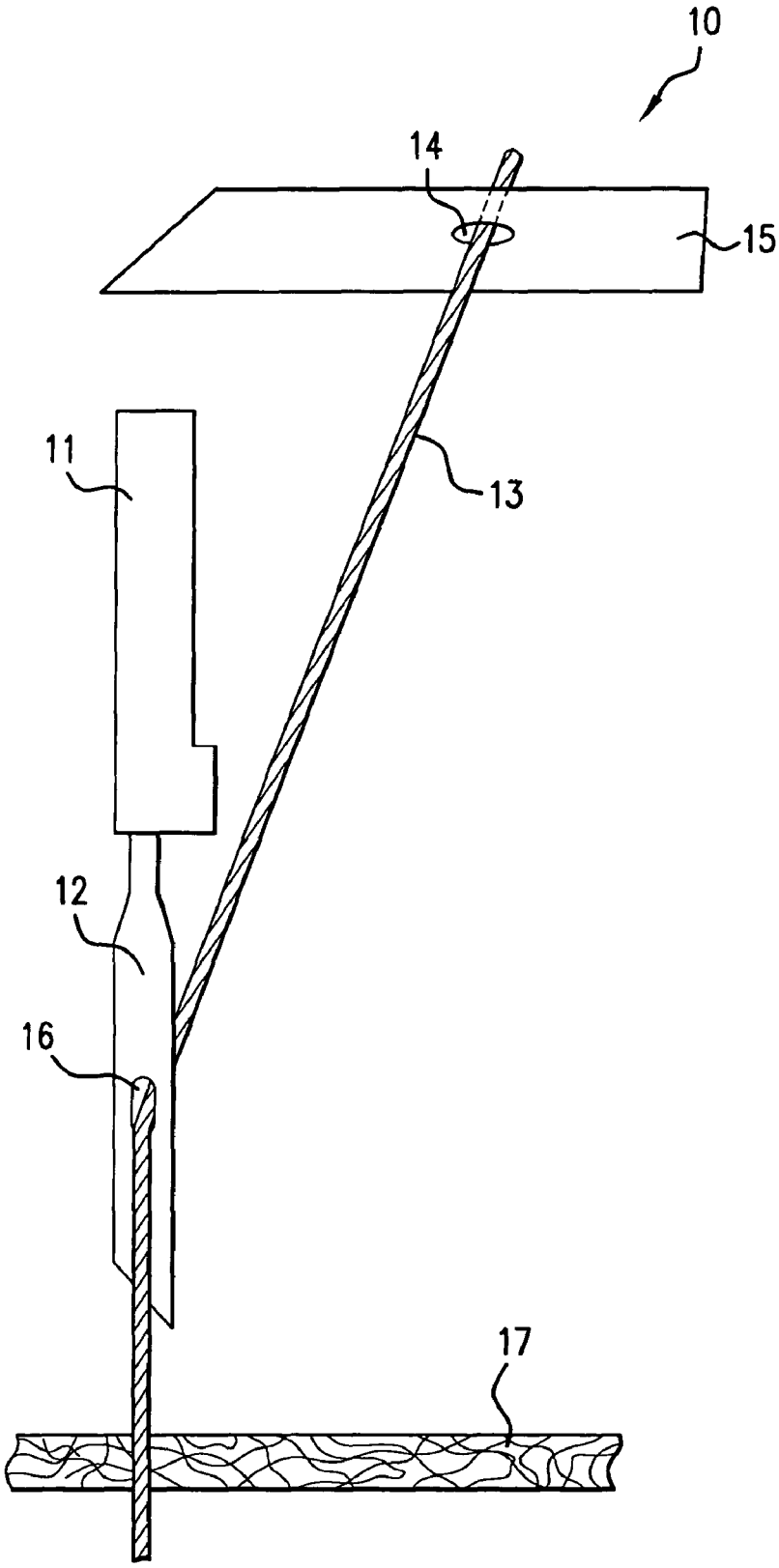
FIG. 1 PRIOR ART
FIG. 1 shows a schematic of a prior art sewing apparatus.

Referring now to FIG. 1, a schematic of a prior art carpet tufting apparatus 10 is shown. A needle bar 11 is coupled to a needle 12. A thread 13 is guided through a bore 14 disposed in a yarn guide plate 15. In industrial carpet tufting machines, it is not uncommon to have approximately 1800 individual strands of thread or yarn guided through several yarn guide plates each spanning several meters. For purposes of illustration and to facilitate understanding of the invention, however, only a single needle 12 and thread 13 are shown and described.

The needle 12 of the carpet tufting apparatus 10 is shown in the uppermost position of the needle stroke. The thread 13 is guided through bore 14 disposed in yard guide plate 15 above the needle bar 11 and obliquely downwardly to the eye 16 of the needle 12 from where the thread 13 extends into a backing material 17 of the tufted product. The needle bar 11 is secured to a suitable stroke member (not shown) and reciprocates and moves downwardly whereby the needle 12 penetrates the backing material 17. Tufting machines are well known, and thus a more detailed description will not be provided herein.

Figure 2:
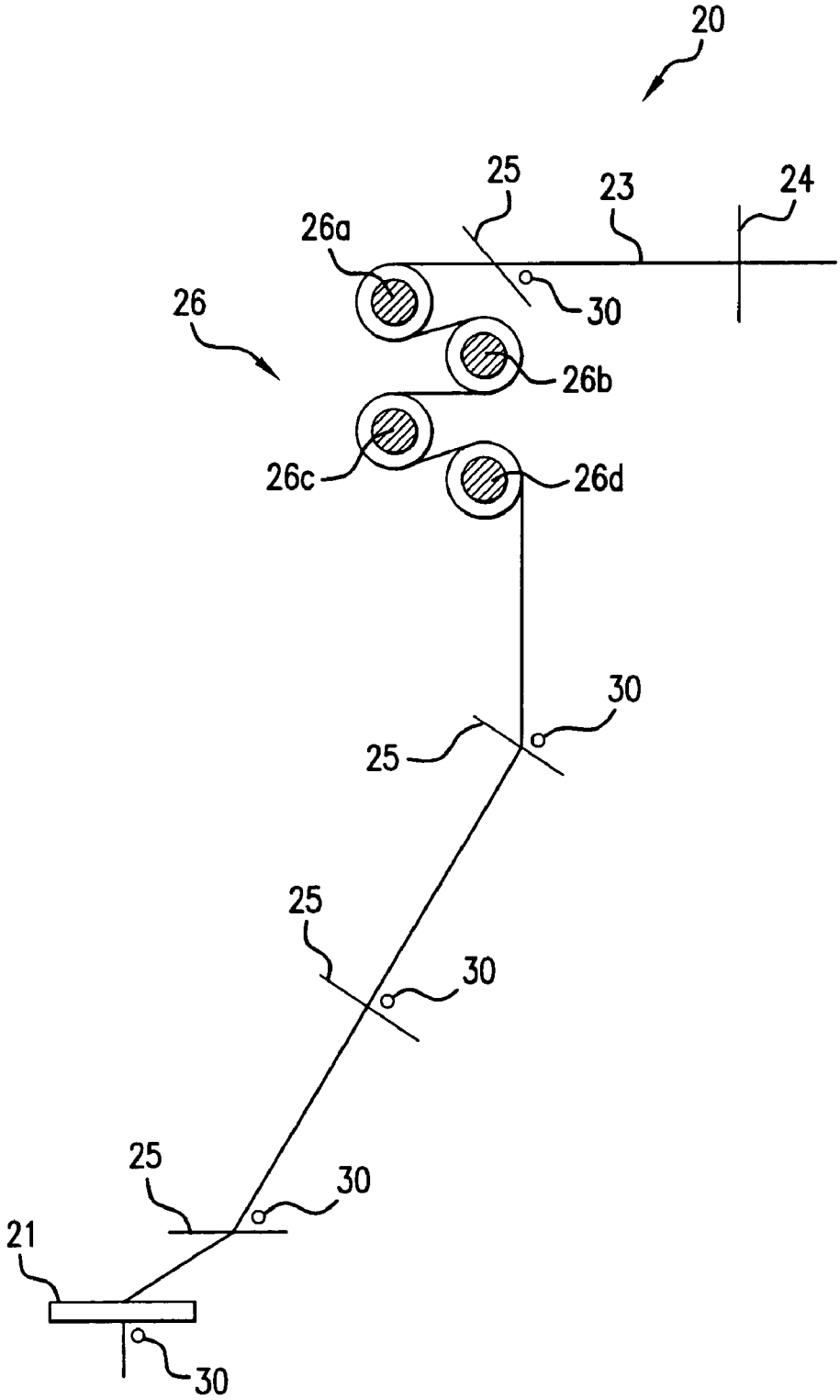
FIG. 2 shows a schematic of an embodiment of a system according to the present invention.

Referring now to FIG. 2, a schematic of system according to an embodiment of the present invention is shown. The system includes a textile sewing apparatus 20, which is shown in a schematic view. In one embodiment, the textile sewing apparatus comprises a carpet tufting apparatus. Alternatively, other suitable textile sewing machines can be used. Thread 23 is supplied to the carpet tufting machine 20 from a yarn supply, such as a creel 24. The thread 23 passes through a plurality of yarn guide plates 25. A yarn feed mechanism 26 includes four rollers 26*a*, 26*b*, 26*c*, and 26*d* over which the thread 23 passes successively, past a needle bar 21 and then to the needle (not shown) and into a backing material (not shown). The rollers 26*a*, 26*b*, 26*c*, and 26*d* are synchronized with each other to feed the thread and are controlled by a synchronous motor.

A thread breakage detection apparatus 30 is coupled to the textile sewing apparatus 20. Preferably, a plurality of thread breakage detection apparatuses 30 are coupled to the textile sewing apparatus 20. In one embodiment, the thread breakage detection apparatus 30 can be attached or fixed to the textile sewing apparatus using brackets, clamps, or other suitable fixing means.

The system shown in FIG. 2 depicts a thread breakage apparatus 30 disposed proximate to each yarn guide plate 25. The placement of the apparatus 30 can include any one or all of the positions disclosed, recognizing that the thread 23 can break anywhere along its path of travel.

Figure 3:
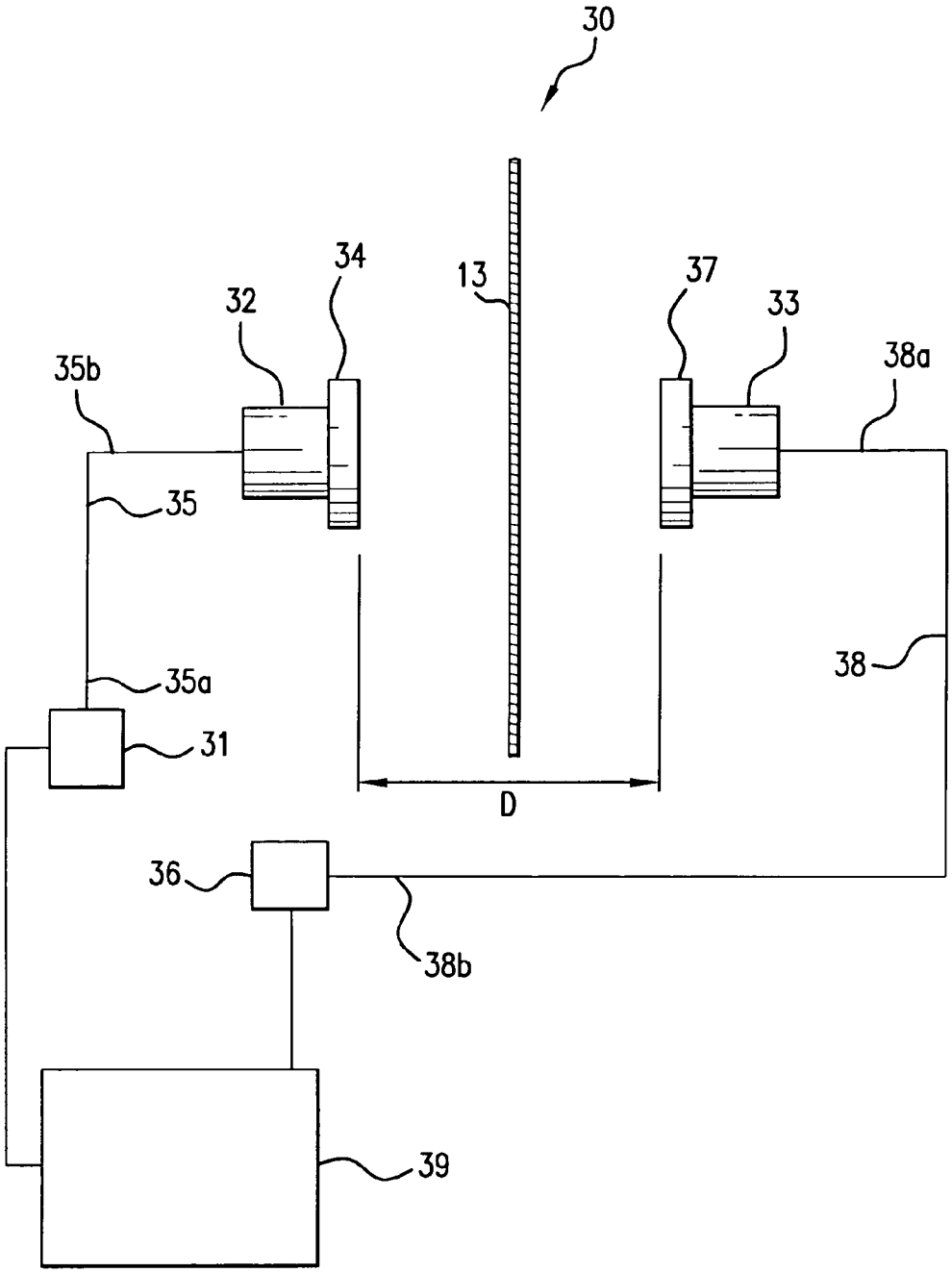
FIG. 3 shows a schematic of a thread breakage detection apparatus according to an embodiment of the present invention.

Referring now to FIG. 3, a schematic of a thread breakage detection apparatus 30 is shown. The thread breakage detection apparatus 30 comprises a light source 31, an emitter 32 in communication with the light source 31, and a receiver 33 in communication with the emitter 32. The terms "communicate" or "communication" mean to mechanically, electrically, optically, or otherwise contact, couple, or connect by either direct, indirect, or operational means.

Preferably, the light source 31 is an LED (light emitting diode). In one embodiment, the light source 31 comprises a 4-element red LED. Alternatively, other suitable light sources can be used. The light source 31 is operable to generate a light beam. In one embodiment, the light beam comprises a wavelength in the infrared range. Generally, the light beam is continuously generated by the light source 31. Alternatively, the light beam can be generated as a series of pulses or packets of light.

The emitter 32 is operable to emit the light beam. The emitter comprises an emitter lens 34 and a first fiber optic cable 35. Preferably, the emitter lens 34 comprises a convex lens having an outside diameter of approximately 4 millimeters and a length of approximately 8.9 millimeters. Preferably, the emitter lens 34 has an effective depth of approximately 3.6 millimeters and a spot facing depth of approximately 0.9 millimeters.

Although shown in schematic form, in one embodiment, the emitter 32 is disposed proximate to the yarn guide plates shown in FIG. 2. In another embodiment, the emitter 32 is disposed proximate to the needle bar 21 shown in FIG. 2. Generally, a distance between a light beam emitted from the emitter 32 and a thread disposed in the textile sewing apparatus 20 comprises a range between approximately 10 millimeters and approximately 25 millimeters. Alternatively, other suitable distances can be used. This distance is generally measured as a perpendicular distance between the longitudinal axis of the light beam (formed by a line between and substantially perpendicular to the emitter 32 and the receiver 33) and an individual thread or a plane formed by a plurality of threads disposed in the textile sewing apparatus 20.

One such suitable lens includes a model F-4 long distance lens manufactured by Keyence Corporation of Osaka, Japan. Another suitable lens includes a model E39-F1 long distance lens manufactured by Omron Corporation of Kyoto, Japan. Alternatively, other suitable lenses can be used.

The first fiber optic cable 35 comprises a proximate end 35*a* and a distal end 35*b*. The proximate end 35*a* of the first fiber optic cable 35 is in communication with the light source 31. The distal end 35*b* of the first fiber optic cable 35 is in communication with the emitter lens 34. Preferably, the distal end 35*b* of the first fiber optic cable 35 comprises a light emitting surface (not shown), which is disposed proximate to and in facing opposition to the emitter lens 34. In one embodiment, the light emitting surface of the first fiber optic cable 35 is in communication with the emitter lens 34. In an alternate embodiment, the light emitting surface of the first fiber optic cable 35 is coupled to the emitter lens 34. Typically, the light beam emitted from the emitter 32 comprises a collimated optical beam (not shown).

The receiver 33 is operable to receive the light beam emitted from the emitter 32 and to communicate the light beam to a sensor 36. Preferably, the sensor 36 is a digital sensor. The receiver 33 comprises a receiving lens 37 and a second fiber optic cable 38. The receiving lens 37 is a convex lens having the characteristics and features as that described above with respect to the emitter lens 34. In one embodiment, the diameter of the receiving lens 37 is substantially equal to or less than a diameter of the thread 23 disposed in the textile sewing apparatus 20.

The receiving lens 37 is disposed in facing opposition to the emitter lens 34. Although FIG. 3 shows the emitter lens 34 and the receiving lens 37 as axially aligned, in practice it is difficult, if not impossible to axially align the emitter lens and the receiving lens 37. The emitter lens 34 and the receiving lens 37 are not required to be axially aligned.

The second fiber optic cable 38 comprises a proximate end 38*a* and a distal end 38*b*. The proximate end 38*a* of the second fiber optic cable 38 is in communication with the receiving lens 37 and the distal end 38*b* of the second fiber optic cable 38 is in communication with the sensor 36. Suitable fiber optic cables for the first and second fiber optic cables 35,38 include an FU-7F thru-beam fiber optic cable manufactured by Keyence Corp. Another suitable fiber optic cable includes the E32-TC 1000 thru-beam fiber optic cable manufactured by Omron Corp. Alternatively, other suitable fiber optic cables can be used.

Preferably, the proximate end 38*a* of the second fiber optic cable 38 comprises a light receiving surface (not shown), which is disposed proximate to the receiving lens 37. In one embodiment, the light receiving surface of the second fiber optic cable 38 is in communication with the receiving lens 34. In an alternate embodiment, the light receiving surface of the second fiber optic cable 38 is coupled to the receiving lens 34.

Generally, the receiving lens is operable to focus the light beam on the light receiving surface of the second fiber optic cable 38. In one embodiment, a distance D between the emitter 32 and the receiver 33 comprises a range between approximately 1 meter and approximately 4 meters.

The sensor 36 is operable to determine a quantity of light received by the receiver 33. The sensor 36 is in communication with the second fiber optic cable 38. Preferably, the sensor 36 is coupled to the distal end 38*b* of the second fiber optic cable 38. In one embodiment, the sensor 36 is in communication with a first processor 39. The sensor 36 is adapted to communicate the quantity of light received to the first processor 39. The sensor 36 is operable to generate a signal associated with the quantity of light received.

The first processor 39 is in communication with the sensor 36 and the light source 31. The first processor 39 is further in communication with a second processor (not shown). The second processor is operable to control the textile sewing apparatus 20. In one embodiment, the second processor comprises a relay. In another embodiment, the second processor comprises a microprocessor, such as for example, a PLC (programmable logic control) or a PC (personal computer). Other suitable processors can be used. Alternatively, the first processor 39 is operable to control the textile sewing apparatus 20 directly without communication to the second processor.

In one embodiment, the first processor 39 is operable to control the light source 31. For example, the first processor 39 is operable to control an amount and duration of power provided to the light source 31. The first processor 39 is operable to associate a first value with a quantity of light emitted from the emitter 32 and to associate a second value with a quantity of light received by the receiver 33. The first processor is operable to compare the first and second values.

Generally, the amount of light emitted from the emitter 32, and thus the first value, is predetermined. The amount of light emitted from the emitter 32 typically is substantially consistent during operation of the thread breakage detection apparatus 30. Of course, the quantity of light emitted from the emitter 32 is determined by the operational conditions of the textile sewing apparatus 20, such as for example ambient light conditions, dust, and vibration.

As discussed above, the first processor 39 is operable to compare first value and the second value. Generally, the first processor stores a predetermined range of second values, which indicate that the light beam has not been interrupted by a broken thread in the textile sewing apparatus. A range of the second values is set to account for variation in the amount of light received by the receiver 33 and to minimize "false positive" signals—i.e., signals that incorrectly indicate an interruption of a break in the light beam.

As discussed above, operating conditions can affect the quantity of light received by the receiver 33, such as for example, ambient lighting conditions, dust, and vibration. Thus, there are no uniform preset values for the first and second values. Rather the first and second values must be determined for the unique ambient conditions in which the breakage apparatus 30 is located.

In one embodiment, the first processor 39 is operable to compare the first and second values approximately every 20 milliseconds. The first processor 39 is operable to generate a stop signal associated with the comparison of the first and second values. Preferably, the first processor 39 generates the stop signal when the second value is outside the predetermined range, thus, indicating that the light beam has been interrupted by a broken thread. The first processor 39 is operable to communicate the stop signal to the second processor. Alternatively, the first processor is operable to communicate the stop signal directly to the textile sewing apparatus 20. In either embodiment, the stop signal is operable to open a main switch (not shown) of the textile sewing apparatus 20, thus halting operation and reducing or eliminating mends.

Although the light source 31, the sensor 36, and the first processor 39 are shown as separate, or stand-alone components, they can be housed in a single or integral unit. One such suitable device includes an FS-V21R Fiber Optic Amplifier manufactured by Keyence Corp. Another suitable device includes an E3X-D11S Fiber Optic Amplifier manufactured by Omron Corp. Alternatively, other suitable systems and components can be used.

Figure 4:
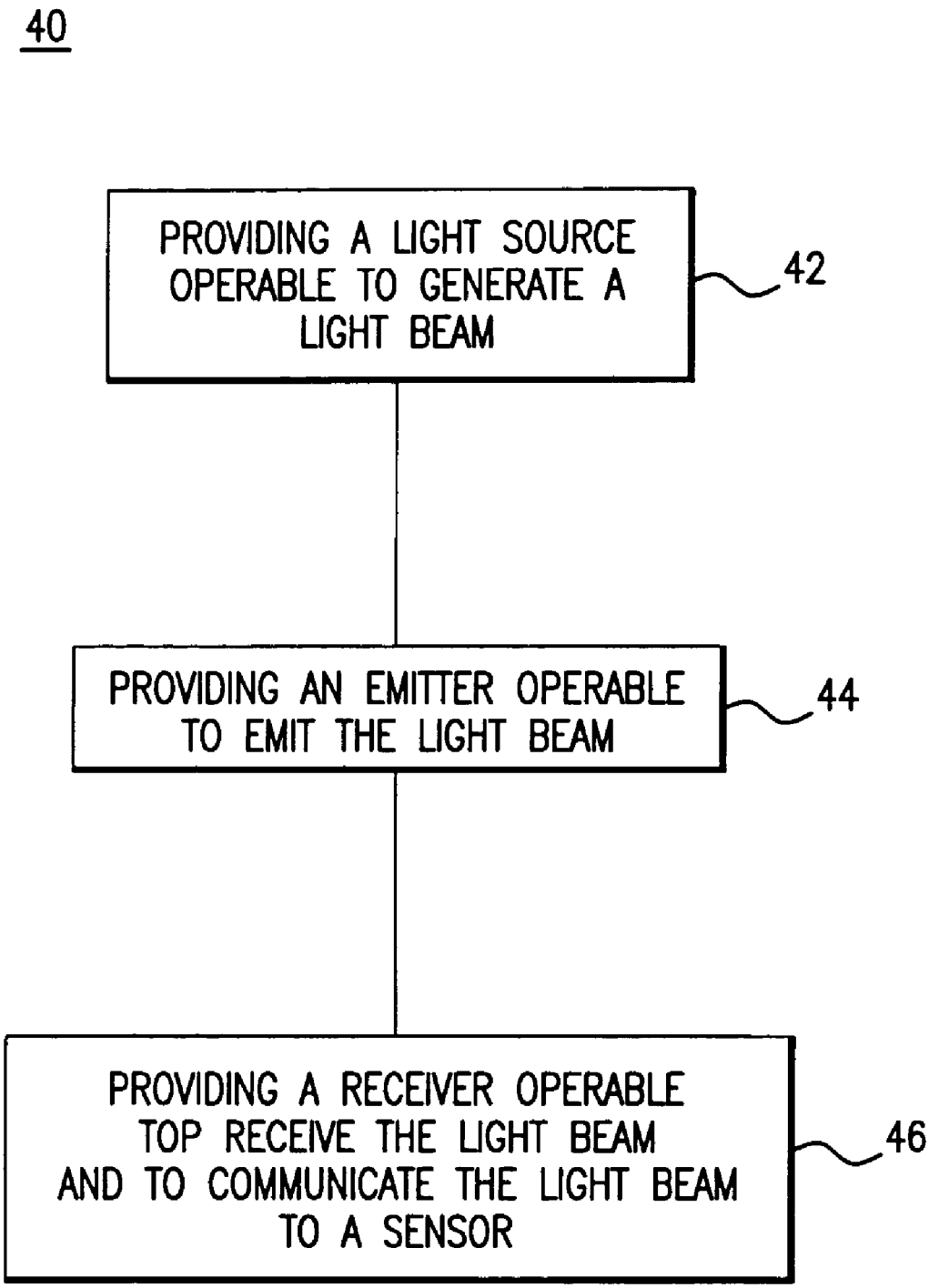
FIG. 4 shows a block diagram of a method according to the present invention.

Referring now to FIG. 4, a method 40 according to an embodiment of the present invention is shown. FIG. 4 shows an embodiment of a method 40 of detecting thread breakage in a textile sewing apparatus. The method 40 may be employed to detect yarn breakage in a carpet tufting machine, as described above. Items shown in FIGS. 1–3 are referred to in describing FIG. 4 to aid understanding of the embodiment of the method 40 shown. However, embodiments of methods according to the present invention may be employed to make a variety of other textile sewing apparatuses.

Referring now to FIG. 4, block 42 indicates that the method 40 comprises providing a light source operable to generate a light beam. Preferably, the light source generates a light beam as that described above and with reference to FIG. 3. Alternatively, the light source can generate a light beam using other suitable means.

As indicated by block 44, the method 40 comprises providing an emitter operable to emit the light beam. The emitter comprises an emitter lens and a first fiber optic cable. The fiber optic cable comprises proximate and distal ends. The proximate end of the fiber optic cable is in communication with the light source and the distal end of the first fiber optic cable is in communication with the emitter lens. In one embodiment, the distal end of the first fiber optic cable is coupled to the emitter lens. The emitter can be as that described above and with reference to FIG. 3. Alternatively, other suitable emitters can be used.

As shown in block 46, the method 40 comprises providing a receiver operable to receive the light beam and to communicate the light beam to a sensor. The receiver comprises a receiving lens and a second fiber optic cable. The second fiber optic cable comprises proximate and distal ends. The proximate end of the fiber optic cable is in communication with the receiving lens and the distal end of the fiber optic cable is in communication with the sensor. In one embodiment, the proximate end of the fiber optic cable is coupled to the receiving lens. Preferably, the receiving lens is disposed in facing opposition to the emitter lens. The receiver can be as that described above and with reference to FIG. 3. Alternatively, other suitable receivers can be used.

In one embodiment, the method 40 comprises providing the emitter in communication with the light source and the receiver. Generally, the receiving lens comprises a diameter substantially equal to or less than a diameter of a thread disposed in the textile sewing apparatus. Typically, the receiving lens is operable to focus the light beam on a surface of the proximate end of the second fiber optic cable.

In one embodiment, the method 40 further comprises providing a first processor in communication with the light source, the sensor, and the second processor. Preferably, the sensor is a digital sensor. Alternatively, an analog sensor can be used. The second processor is operable to control the textile sewing apparatus. In one embodiment, the second processor comprises a relay. In another embodiment, the second processor comprises a microprocessor, such as a PLC or a PC. Alternatively other microprocessors can be used. The first and second processors can be as that described above and with reference to FIG. 3. Alternatively, other suitable processors can be used.

Generally, the first processor is operable to associate a first value with a quantity of light emitted from the emitter and to associate a second value with a quantity of light received by the receiver. In one embodiment, the first processor is operable to compare the first and second values. Typically, the first processor is operable to generate a signal associated with the comparison of the first and second values and to communicate the signal to the second processor. Alternatively, the first processor is operable to communicate the signal directly to the textile sewing apparatus.

The operation of the first processor and its control of the textile sewing apparatus can be as that described above and with reference to FIG. 3. Alternatively, other suitable operation of the first processor can be used such that thread breakage is detected by the light beam and operation of the thread sewing apparatus is halted thereafter.

While the present invention has been disclosed with reference to certain embodiments, numerous modifications, alterations, and changes to the described embodiments are possible without departing from the sphere and scope of the present invention, as defined by the appended claims. Accordingly, it is intended that the present invention not be limited to the described embodiments, but that it has the full scope defined by the language of the following claims, and equivalents thereof.

What is claimed is:

1. A system comprising:

a textile sewing apparatus having at least one yarn guide plate defining a plurality of holes through which thread may pass; and a thread breakage detection apparatus coupled to the textile sewing apparatus, the thread breakage detection apparatus comprising:

a light source operable to generate a light beam;

an emitter in communication with the light source, the emitter operable to emit the light beam, the emitter comprising an emitter lens; and a receiver in communication with the emitter, the receiver operable to receive the light beam emitted from the emitter and to communicate the light beam to a sensor, the receiver comprising a receiving lens, wherein in order to minimize false positives:

the light beam is proximate to the yarn guide plate, and a distance between the light beam and a thread disposed in one of the plurality of holes defined by the yarn guide plate comprises approximately 10 millimeters.

2. The system of claim 1, wherein the light beam comprises a wavelength in the infrared range.

3. The system of claim 1, wherein the receiving lens comprises a diameter, the diameter substantially equal to or less than a diameter of a thread disposed in the textile sewing apparatus.

4. The system of claim 1, wherein the light beam emitted from the emitter comprises a collimated optical beam.

5. The system of claim 1, wherein the receiving lens is operable to focus the light beam on a surface of the proximate end of the second fiber optic cable.

6. The system of claim 1, further comprising a first processor and a second processor, the first processor in communication with the light source, the sensor, and the second processor, the second processor operable to control the textile sewing apparatus.

7. The system of claim 6, wherein the second processor comprises a relay.

8. The system of claim 6, wherein the second processor comprises a microprocessor.

9. The system of claim 6, wherein the first processor is operable to associate a first value with a quantity of light emitted from the emitter and to associate a second value with a quantity of light received by the receiver.

10. The system of claim 9, wherein the first processor is operable to compare the first and second values.

11. The system of claim 10, wherein the first processor is operable to generate a signal associated with the comparison of the first and second values and to communicate the signal to the second processor.

12. The system of claim 1, wherein a distance between the light beam and a thread disposed in the textile sewing apparatus comprises a range between approximately 10 millimeters and approximately 25 millimeters.

13. The system of claim 1, wherein the textile sewing apparatus comprises a carpet tufting apparatus comprising a yarn guide plate and a needle bar.

14. The system of claim 13, wherein the emitter is disposed proximate to the yarn guide plate.

15. The system of claim 13, wherein the emitter is disposed proximate to the needle bar.

16. The system of claim 1, wherein a distance between the emitter and the receiver is greater than approximately 1 meter.

17. A method of detecting thread breakage in a textile sewing apparatus, the method comprising:

providing a textile sewing apparatus having at least one yarn guide plate defining a plurality of holes through which thread may pass;

providing a thread breakage detection apparatus coupled to the textile sewing apparatus, the thread breakage detection apparatus comprising:

a light source operable to generate a light beam;

an emitter operable to emit the light beam, the emitter comprising an emitter lens; and a receiver operable to receive the light beam and to communicate the light beam to a sensor, the receiver comprising a receiving lens disposed in facing opposition to the emitter lens, wherein in order to minimize false positives:

the light beam is proximate to the yarn guide plate, and a distance between the light beam and a thread disposed in one of the plurality of holes defined by the yarn guide plate comprises approximately 10 millimeters.

18. The method of claim 17, further comprising providing the emitter in communication with the light source and the receiver.

19. The method of claim 17, wherein the receiving lens comprises a diameter substantially equal to or less than a diameter of a thread disposed in the textile sewing apparatus.

20. The method of claim 17, wherein the receiving lens is operable to focus the light beam on a surface of the proximate end of the second fiber optic cable.

21. The method of claim 17, further comprising providing a first processor and a second processor, the first processor in communication with the light source, the sensor, and the second processor, the second processor operable to control the textile sewing apparatus.

22. The method of claim 21, wherein the second processor comprises a relay.

23. The method of claim 21, wherein the second processor comprises a microprocessor.

24. The method of claim 21, wherein the first processor is operable to associate a first value with a quantity of light emitted from the emitter and to associate a second value with a quantity of light received by the receiver.

25. The method of claim 24, wherein the first processor is operable to compare the first and second values.

26. The method of claim 25, wherein the first processor is operable to generate a signal associated with the comparison of the first and second values and to communicate the signal to the second processor.

27. A thread breakage detecting apparatus adapted to be coupled to a textile sewing apparatus, the thread breakage detecting apparatus comprising:

a light source operable to generate a light beam;

an emitter in communication with the light source, the emitter operable to emit the light beam, the emitter comprising an emitter; and a receiver in communication with the emitter, the receiver operable to receive the light beam and to communicate the light beam to a sensor, the receiver comprising a receiving lens disposed in facing opposition to the emitter lens, wherein in order to minimize false positives:

the light beam is proximate to a yarn guide plate of the sewing apparatus, the yarn guide plate defining a plurality of holes through which thread may pass, and a distance between the light beam and a thread disposed in one of the plurality of holes defined by the yarn guide plate comprises approximately 10 millimeters.

28. The apparatus of claim 27, wherein the receiving lens comprises a diameter, the diameter substantially equal to or less than a diameter of a thread disposed in the textile sewing apparatus.

29. The apparatus of claim 27, wherein the receiving lens is operable to focus the light beam on a surface of the proximate end of the second fiber optic cable.

30. The apparatus of claim 27, further comprising a processor in communication with the light source and the sensor, the processor operable to associate a first value with a quantity of light emitted from the emitter and a second value with a quantity of light received by the receiver.

31. The apparatus of claim 30, wherein the processor is operable to compare the first and second values and to generate a signal associated with the comparison of the first and second values, the signal operable to control the textile sewing apparatus.

32. The apparatus of claim 27, wherein a distance between the emitter and the receiver is greater than approximately 1 meter.

33. The system of claim 1, further comprising:

a processor in communication with the emitter and the receiver, the processor operable to associate a first value with a quantity of light emitted from the emitter and a second value with a quantity of light received by the receiver.

34. The system of claim 1, wherein the emitter lens comprises an effective depth of approximately 3.6 millimeters and a spot facing depth of approximately 0.9 millimeters.

35. A system comprising:

a textile sewing apparatus having at least one yarn guide plate defining a plurality of holes through which thread may pass; and a thread breakage detection apparatus coupled to the textile sewing apparatus, the thread breakage detection apparatus comprising:

a light source operable to generate a light beam;

an emitter in communication with the light source, the emitter operable to emit the light beam, the emitter comprising an emitter lens; and a receiver in communication with the emitter, the receiver operable to receive the light beam emitted from the emitter and to communicate the light beam to a sensor, the receiver comprising a receiving lens disposed in facing opposition to the emitter lens, wherein in order to minimize false positives:

the light beam is proximate to the yarn guide plate, and a distance between the light beam and a thread disposed in one of the plurality of holes defined by the yarn guide plate comprises a range between approximately 10 millimeters and approximately 25 millimeters.

* * * * *